US007415734B2

(12) United States Patent
Donnelly

(10) Patent No.: US 7,415,734 B2
(45) Date of Patent: Aug. 26, 2008

(54) THERMALLY-INSULATIVE, BREAST-SUPPORTIVE UNDERGARMENT

(76) Inventor: Jennifer B. Donnelly, 33319 Rule Ct., Wildwood, IL (US) 60030

( * ) Notice: Subject to any disclaimer, the term of this patent is extended or adjusted under 35 U.S.C. 154(b) by 494 days.

(21) Appl. No.: 10/988,817

(22) Filed: Nov. 15, 2004

(65) Prior Publication Data

US 2006/0105672 A1 May 18, 2006

(51) Int. Cl.
*A41D 1/18* (2006.01)

(52) U.S. Cl. ..... 2/106; 450/66

(58) Field of Classification Search ..... 2/105, 2/106, 67, 69, 82, 81, 92, 102, 113–115, 2/104; 450/65–68, 71–77, 93
See application file for complete search history.

(56) References Cited

U.S. PATENT DOCUMENTS 647,154 A 4/1900 Phillips
1,190,602 A 7/1916 Sorkin
1,276,266 A 8/1918 Querns
1,420,248 A 6/1922 Fay
1,434,944 A 11/1922 Cooper
1,510,428 A 9/1924 Voliva
1,980,767 A 11/1934 Snader
2,707,284 A 5/1955 Artzt
3,189,028 A 6/1965 Dormire
1,422,818 A 1/1969 Erteszek
3,430,632 A 3/1969 James et al.
3,467,105 A 9/1969 White
3,488,776 A * 1/1970 Luhr ..... 2/109
3,633,215 A 1/1972 Richards
4,174,717 A 11/1979 Schreiber et al.
4,289,137 A 9/1981 Dell et al.
4,311,150 A 1/1982 Schreiber et al.
4,341,219 A 7/1982 Kutnetz
4,510,626 A 4/1985 Bowditch
4,531,525 A 7/1985 Richards
4,538,614 A 9/1985 Henderson
4,583,544 A * 4/1986 Flanagan et al. ..... 450/58
4,601,069 A 7/1986 Fiore, Jr. et al.
4,781,651 A 11/1988 Ekins
4,816,005 A 3/1989 Braatan
4,907,295 A * 3/1990 Yasuda ..... 2/2.16
4,909,771 A 3/1990 Bergman
4,956,878 A 9/1990 Boynton (Continued)

*Primary Examiner*—Gloria Hale
(74) *Attorney, Agent, or Firm*—Meroni & Meroni, P.C.; Charles F. Meroni, Jr.; Christopher J. Scott

(57) ABSTRACT

A thermally-insulative, breast-supportive undergarment comprising an anterior fabric portion, a posterior fabric portion, and an elastic band member is disclosed. The anterior fabric portion and the posterior fabric portion each essentially comprise thermally-insulative material having latitudinally-oriented fabric elasticity. The anterior fabric portion and the posterior fabric portion are attached to one anther at seam sections to cooperatively form a neck-covering sleeve, a midriff-receiving aperture, and laterally opposed arm-receiving apertures. The elastic band member is cooperatively associated with the midriff-receiving aperture and inherently has bidirectional band elasticity. The bidirectional band elasticity is also latitudinally-oriented. The fabric elasticity and the band elasticity provide the undergarment with breast-supportive resilience; and the thermally-insulative material, the fabric elasticity, and the band elasticity together cooperate to provide a user with a thermally-insulative, breast-supportive undergarment. Optionally, the thermally-insulative, breast-supportive undergarment may comprise moisture-wicking lining structure, which lining structure also essentially comprises bidirectional, latitudinally-oriented liner elasticity.

25 Claims, 9 Drawing Sheets

U.S. PATENT DOCUMENTS

| | | | | |
|---|---|---|---|---|
| 4,957,466 | A | 9/1990 | Hoppe | |
| 4,999,845 | A * | 3/1991 | Jenks et al. | 2/2.16 |
| D316,322 | S | 4/1991 | Bosler et al. | |
| 5,011,452 | A | 4/1991 | Kelly | |
| D321,083 | S | 10/1991 | Thygesen | |
| 5,119,511 | A | 6/1992 | Packer et al. | |
| 5,211,598 | A | 5/1993 | Hall | |
| 5,553,468 | A | 9/1996 | Osborne | |
| D388,587 | S | 1/1998 | Magidson et al. | |
| 5,871,388 | A | 2/1999 | Lambert | |
| 5,873,767 | A | 2/1999 | Pickett | |
| 5,944,579 | A | 8/1999 | Fleischman | |
| 5,946,726 | A | 9/1999 | Green | |
| 5,954,681 | A | 9/1999 | Brooks | |
| 6,099,382 | A | 8/2000 | Wilson | |
| 6,178,784 | B1 | 1/2001 | Marley, Jr. | |
| D438,691 | S | 3/2001 | Zagame | |
| 6,292,947 | B1 * | 9/2001 | Bechis | 2/67 |
| 6,688,942 | B2 | 2/2004 | Holliday | |
| 2001/0019933 | A1 | 9/2001 | Wagner | |

* cited by examiner

THERMALLY-INSULATIVE, BREAST-SUPPORTIVE UNDERGARMENT

BACKGROUND OF THE INVENTION

1. Field of the Invention

The present invention generally relates to a thermally-insulative, breast-supportive garment. Thus, the garment of the present invention functions to firstly provide a thermally-insulative fabric layer superficial to the skin of the upper torso region, with particular target areas being the thoracic and abdominal regions. Further, the garment functions to provide fabric-based support structure for the breasts of female users. More particularly, the present invention relates to a thermally-insulative brassiere or camisole, which when worn, provides users with means for both thermally insulating the upper torso region as well as supporting the breasts of the upper torso region.

2. Description of the Prior Art

Key to success in any winter or outdoor sporting activity is the requirement to dress adequately. It is noted that the human body ordinarily remains at a fairly constant temperature of 37° Celcius (98.6° Fahrenheit). It is very important that this body temperature be maintained and, since there is a continuous body heat gain from internal body processes, there must also be a continuous body heat loss to maintain body heat in balance. Excess heat must be absorbed by the surrounding air or lost by radiation. As the temperature and humidity of the environment in which a human body is active varies, the human body automatically regulates the amount of heat it gives off. However, the human body's ability to adjust to varying environmental conditions is limited. Furthermore, although the body may adjust to a certain (limited) range of atmospheric conditions, it does so with a distinct feeling of discomfort. The following is a brief discussion of how atmospheric conditions affect the body's ability to maintain a heat balance and the background information supporting the development of the present invention.

The human body gains and loses heat by radiation, convection, conduction, evaporation, and as a by-product of other physiological processes that take place within the body, namely the oxidation of food, other chemical processes, and by friction and tension within muscle tissues. Most body heat, however, is produced by the foods consumed by the individual, which body heat must be removed continuously or body temperature would steadily rise. The principal routes of body heat loss include radiation, conduction, convection, and evaporation. Radiation is the transfer of heat as infrared heat rays from a warmer object to a cooler object without physical contact. The human body loses heat by the radiation of heat waves to cooler objects nearby such as ceilings, floors and walls. If these objects are at a higher temperature, the human body absorbs heat by radiation. Incidentally, air temperature has no relationship to the radiation of heat to and from objects. Skiers, for example, are, on occasion, able to comfortably remove clothing in bright sunshine even though the air temperature is very low because the radiant heat from the sun is adequate to warm the skier. In a room at 21° C. (70° F.), about 60 percent of heat loss is by radiation in a resting person.

Conduction is the process by which body heat is transferred to a substance or object in contact with the body, such as chairs, clothing, jewelry, air or water. At rest, about 3 percent of body heat is lost via conduction to solid objects. The contact of air or water with the human body results in heat transfer by both conduction and convection. Convection is the transfer of heat by the movement of a liquid or gas between areas of different temperature. When cool air makes contact with the body, it becomes warmed and less dense. The less dense air then rises. Subsequently, cool air makes contact with the body and is carried away as it warms by conduction and becomes less dense. The faster the air moves, the faster the rate of convection. When at rest, about 15 percent of body heat is lost to the air by conduction and convention.

Evaporation is the conversion of a liquid to vapor. Water has a high heat of evaporation, and because of this characteristic, every gram of water (as found in perspiration) evaporating from the skin takes with it a relatively great deal of heat—on the order of about 0.58 kilocalories per gram of water. Under normal conditions, about 22 percent of heat loss occurs through evaporation. Under extreme conditions, about 4 liters of perspiration are produced each hour, and this volume can remove about 2,000 kilocalories of heat from the body. This is approximately 32 times the basal level of heat production.

Even though there are wide fluctuations in environmental temperature, the human body's homeostatic mechanisms can maintain a normal range for the internal body temperature. If the body heat production equals the body heat loss, the body maintains a constant core temperature near the earlier cited 37° C. Body heat losses may be classified in two general categories, namely, loss of sensible heat and loss of latent heat. Sensible heat is given off by radiation, convection and conduction. Latent heat is given off in the breath and by evaporation or perspiration. In perfectly still air, the layer of air around a body absorbs the sensible heat given off by the body and increases in temperature. The layer of air also absorbs some of the water vapor given off by the body, thus increasing the relative humidity. This means the body is surrounded by an envelope of moist air that is at a higher temperature and relative humidity than the ambient air. Therefore, the amount of heat the body can lose to this envelope is less than the amount it can lose to the ambient air. When the air is set in motion past the body, the envelope is continually being removed and replaced by the ambient air, thereby increasing the rate of heat loss from the body. When the increased heat loss improves the body heat balance, the sensation of a breeze is felt; when the increase is excessive, the rate of heat loss makes the body feel cool and the sensation of a draft is felt.

From the foregoing discussion, it is evident that the three factors, namely temperature, humidity, and air motion, are closely interrelated in their effects upon the comfort and health of winter or outdoor sports enthusiasts. In fact, a given combination of temperature, humidity, and air motion will produce the same feeling of warmth of coolness as a higher or lower temperature in conjunction with a compensating humidity and air motion. The term given to the net effect of these three factors is known as the Effective Temperature. Effective Temperature cannot be measured by an instrument, but can be found on a special psychometric chart when the temperatures and air velocity are known. The combinations of temperature, relative humidity, and air motion of a particular Effective Temperature may produce the same feeling of warmth or coolness. However, they are not all equally comfortable. Relative humidity below about 15 percent produces a parched condition of the mucous membranes of the mouth, nose and lungs, and increases susceptibility to disease germs. Relative humidity above about 70 percent causes an accumulation of moisture in the clothing. For the best health conditions, relative humidity ranges from about 40 to 50 percent for cold weather and from 50 to 60 percent for warm weather.

As earlier stated, most of the body heat produced by the human body comes from oxidation of the food humans eat.

The rate at which this heat is produced is referred to as the metabolic rate. Among the factors that affect the metabolic rate are the following: exercise, nervous system, hormones, body temperature, food ingestion, age and several other variables of lesser direct involvement, namely gender, climate, sleep, and malnutrition. During strenuous exercise activity, such as skiing or snowboarding, the metabolic rate may increase to as much as 15 times the normal rate; in well-trained athletes, the rate may increase to a rate 20 times the normal metabolic rate. Thus, it will be understood that adequate clothing protection for the winter or outdoor sports enthusiast is essential. Further, providing adequate breast support for female sports enthusiasts is also essential. In this regard, it is thus noted that various types of athletic sports type brassieres are known in the art. Some of the more pertinent prior art relating to athletic sports brassieres and the like is described hereinafter.

U.S. Pat. No. 1,434,944 ('944 patent), which issued to Cooper, discloses a Brassiere. The '944 patent teaches a brassiere comprising front, rear, and shoulder portions forming an elongated neck opening therebetween, the front and rear portions extended laterally beyond the shoulder portions into substantial juxtaposition to form an arm opening and the side edges of each of said front and rear portions converging in a direction away from the neck opening, and means for securing said converging edges, said securing means including parts extending beyond both of said edges, whereby the said juxtaposed edges are held in substantially a common plane.

U.S. Pat. No. 1,980,767 ('767 patent), which issued to Snader, discloses a Brassiere. The '767 patent teaches a brassiere comprising a sheer inelastic body portion freely enveloping the breasts and a relatively stiff band of elastic webbing fixed to the bottom edge of the body portion adapted to encircle the body of the wearer contractively in a zone beneath the breasts affording a firm line of support for the breasts solely at the base, leaving otherwise free to assume a natural contour determined by said support, and the front of the band being deflected upwardly toward the middle of the front, in the unworn garment, whereby when the band is distended by the body of the wearer, the lower edge will be tensioned to a greater extent than the upper edge, to prevent rolls.

U.S. Pat. No. 3,430,632 ('632 patent), which issued to James et al., discloses a Brassiere. The '632 patent teaches a brassiere of endless construction having sufficient elasticity to permit donning thereof by stepping thereinto or by slipping over the shoulders and freedom of movement of the body when properly positioned while adequately supporting the breasts without undue confinement.

U.S. Pat. No. 3,488,776 ('776 patent), which issued to Luhr, discloses a Slip-Over Garment. The '776 patent teaches a slip-over garment or dickey of abbreviated dimensions comprising a body member formed by sewing together two mating pieces of a stretchable fabric such as nylon. The body member is formed with a pair of armholes, a torso opening, and a neck hole. If desired, a stretchable fabric collar, which can also be nylon, may be sewn to the main body member at the neck opening in order to form a turtleneck, V-neck, boat neck or the like. A zipper may also be included to facilitate donning and removal of the garment. An elastic band about ⅝ inch wide is secured to the lower extremity of the dickey around its circumference in order to assist in preventing the garment from riding up on the torso while the wearer is engaging in normal activity.

U.S. Pat. No. 4,174,717 ('717 patent), which issued to Schreiber et al., discloses an Athletic Brassiere. The '717 patent teaches an athletic brassiere, particularly suitable for women runners, which holds the breasts comfortably and snugly to the body. A wide elastic rib band and elastic straps which cross in the back hold the brassiere firmly in place. Non-irritating material is used and all seams face the outside. All hardware is eliminated. The cups are not shaped but are preferably made of elastic material to pull the breasts in snugly against the body.

U.S. Pat. No. 4,583,544 ('544 patent), which issued to Flanagan et al., discloses a Sports Bra. The '544 patent teaches a bra for particular use during sporting activity. The bra has no cups formed in the material, and seams are otherwise avoided. The bra is, essentially, formed as one continuous knitted piece with a two way stretch and the rear of the bra has a height almost the same as that of the front of the bra to provide added support.

U.S. Pat. No. 4,909,771 ('771 patent), which issued to Bergman, discloses a Brassiere. The '771 patent teaches an improved brassiere in which the breast supporting fabric comprises cotton/Lycra, which is initially flat but which, without the use of seams, darts, moldings or shaping, stretches around and generally conforms to the shape of the wearer's breasts to hold them against the body. A feature of the preferred bra is that it is devoid of all hardware such as clips or buckles and it includes a wide midriff portion at the front, sides and back for improved support.

From an inspection of these patent disclosures and other art generally known in the relevant art, it will be seen that the prior art does not teach a thermally-insulative, breast supportive undergarment comprising an anterior fabric portion and a posterior fabric portion each portion comprising thermally-insulative material having bidirectional or girthwise fabric elasticity. More particularly, the prior art does not teach anterior fabric portion and a posterior fabric portion wherein the anterior fabric portion comprises an anterior neck portion, an anterior midriff portion, laterally opposed anterior arm portions, and a plurality of anterior seam sections, and the posterior fabric portion comprises a posterior neck portion, a posterior midriff portion, laterally opposed posterior arm portions, and a plurality of posterior seam sections. Further, the prior art does not teach an undergarment comprising anterior seam sections and posterior seam sections such that when the sections are attached to one another, the anterior and posterior neck portions cooperatively form select neck-encircling structure, the anterior and posterior midriff portions cooperatively forming a midriff-receiving aperture, and the anterior and posterior arm portions cooperatively form laterally opposed arm-receiving apertures, wherein the bidirectional fabric elasticity provides breast-supportive resilience and wherein the thermally-insulative material and the fabric elasticity cooperatively provide a wearer with a thermally-insulative, breast-supportive undergarment. Thus, the prior art perceives a need for a thermally-insulative, breast supportive undergarment as briefly described hereinabove.

SUMMARY OF THE INVENTION

It is a primary object of the present invention to provide a low cost, thermally-insulative, breast-supportive undergarment for female sports enthusiasts desirous of donning a breast-supportive undergarment that simultaneously functions to effectively insulate the upper torso region during sporting activity. It is a further object of the present invention to provide a soft-to-the-touch, warm (or thermally-insulative), supportive sports bra or sports type brassiere that functions to keep wearers thereof dryer and warmer during sporting activity. Further, it is an object of the present invention to provide various styles of the thermally-insulative, breast-supportive undergarment so as to suit the fancy of most female sports enthusiasts. Thus, it will be seen that turtleneck type undergarments are disclosed for those who are desirous of obtaining a more insulative type garment as well as camisole type undergarments for those who are desirous of obtaining a less-supportive type undergarment, but who are still desirous of obtaining a soft-to-the-touch, thermally-insulative and perspiration-wicking base layer.

To achieve these and other readily apparent objectives, the present invention essentially provides a thermally-insulative, breast-supportive undergarment comprising an anterior fabric portion, a posterior fabric portion, and, in the brassiere type version, an elastic band member. The anterior fabric portion and the posterior fabric portion each essentially comprise thermally-insulative material such as POLARTEC® brand fleece to provide a warm, soft-to-the-touch undergarment. Notably, the material from which the undergarment is constructed must have bidirectional or girthwise fabric elasticity, which bidirectional fabric elasticity is latitudinally oriented. The anterior fabric portion has an anterior portion periphery, which periphery has a relaxed anterior periphery dimension. The anterior portion periphery comprises an anterior neck portion, an anterior midriff portion, laterally opposed anterior arm portions, and a plurality of anterior seam sections.

The posterior fabric portion has a posterior portion periphery, which periphery has a relaxed posterior periphery dimension. The posterior portion periphery comprises a posterior neck portion, a posterior midriff portion, laterally opposed posterior arm portions, and a plurality of posterior seam sections. Notably, the relaxed anterior periphery dimension is greater in magnitude than the relaxed posterior periphery dimension. The anterior seam sections are stitched to the posterior seam sections and thus the anterior and posterior neck portions cooperatively form a neck-covering sleeve; the anterior and posterior midriff portions cooperatively form a midriff-receiving aperture; and the anterior and posterior arm portions cooperatively form laterally opposed arm-receiving apertures.

The elastic band member is cooperatively associated with the midriff-receiving aperture. Notably, the elastic band member inherently has bidirectional band elasticity. The bidirectional band elasticity, like the fabric elasticity, is also latitudinally-oriented. The fabric elasticity and the band elasticity provide the undergarment with breast-supportive resilience; and the thermally-insulative material, together with the fabric elasticity and the band elasticity, cooperate to provide a user with a thermally-insulative, breast-supportive undergarment. Optionally, the thermally-insulative, breast-supportive undergarment may comprise moisture-wicking lining structure, which lining structure may also comprise bidirectional, latitudinally-oriented liner elasticity.

Other objects of the present invention, as well as particular features, elements, and advantages thereof, will be elucidated in, or apparent from, the following description and the accompanying drawing figures.

BRIEF DESCRIPTION OF THE DRAWINGS

Other features of my invention will become more evident from a consideration of the following brief description of patent drawings, as follows:

FIG. 3(*a*) is a cross-sectional side view of the anterior fabric portion and the anterior liner portion of the thermally-insulative, breast-supportive undergarment.

DETAILED DESCRIPTION OF THE PREFERRED EMBODIMENT

Figure 1:
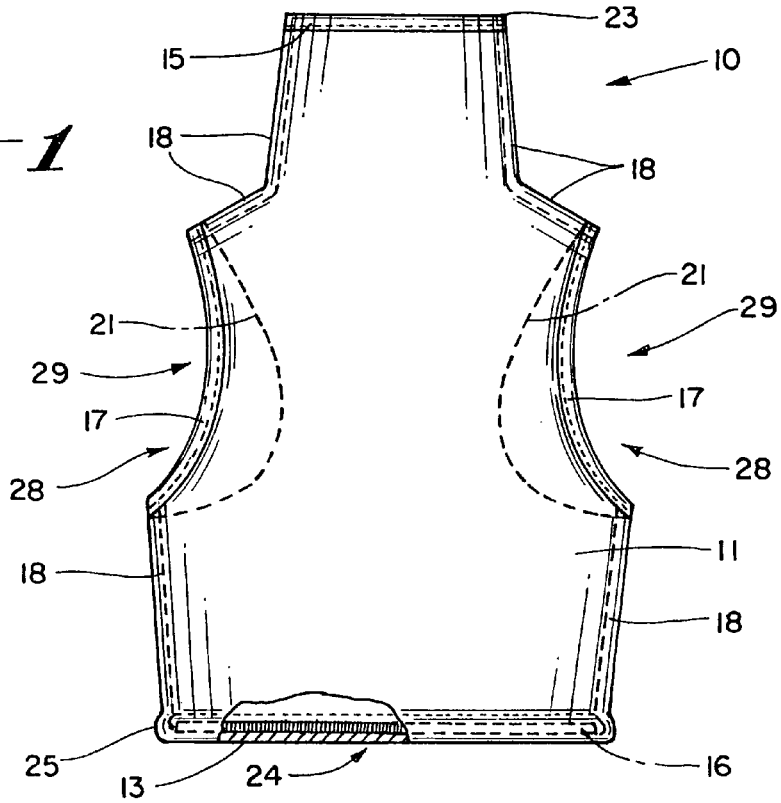
FIG. 1 is front plan view of the preferred embodiment of the thermally-insulative, breast-supportive undergarment showing a fully extended neck-covering sleeve and parts broken away to show an elastic band member.
Figure 2:
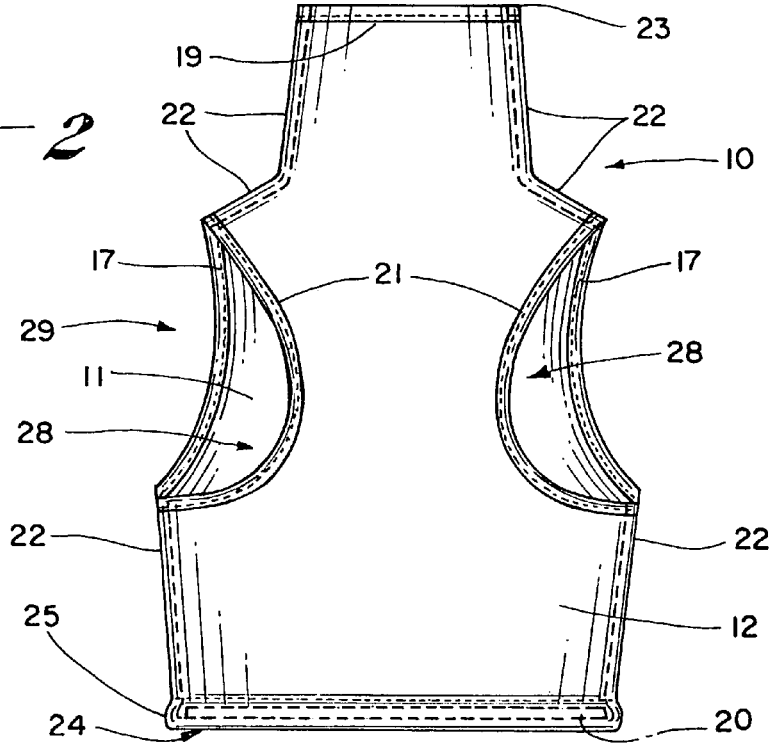
FIG. 2 is a back plan view of the thermally-insulative, breast-supportive undergarment illustrated in FIG. 1.
Figure 3:
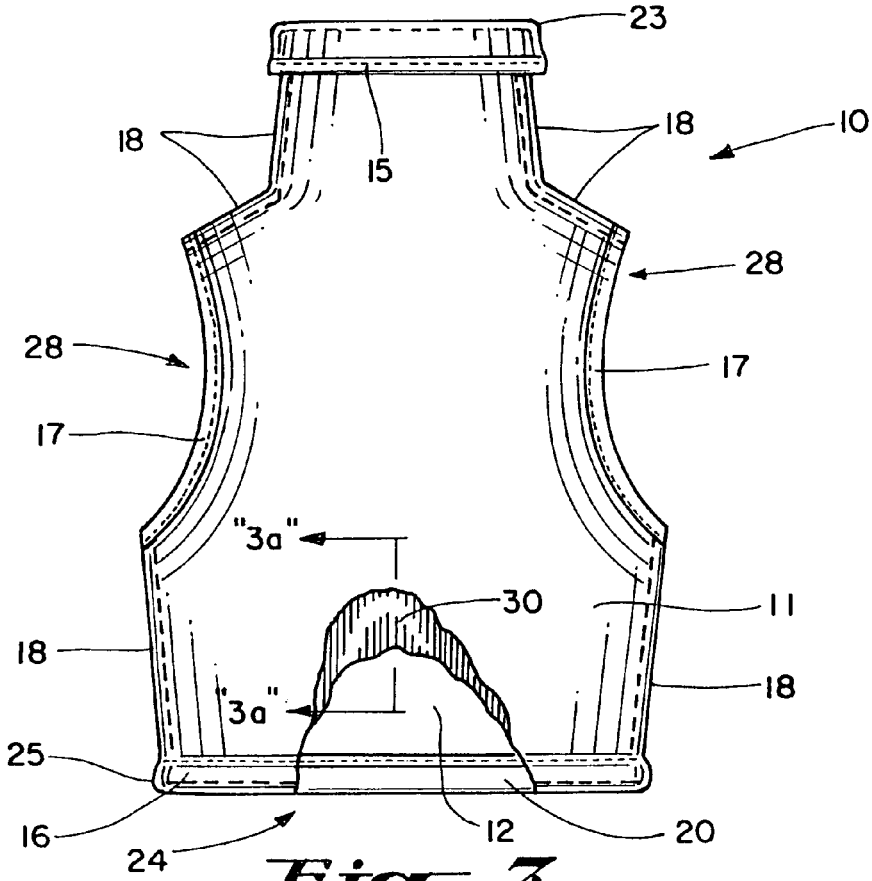
FIG. 3 is a front plan view plan of the preferred embodiment of the thermally-insulative, breast-supportive undergarment showing a folded-over neck-covering sleeve and parts broken away to show an anterior liner portion.
Figure 3A:
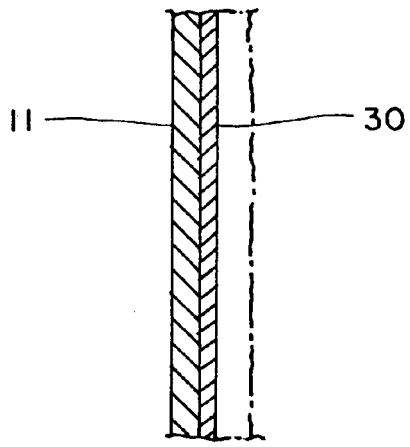

Referring now to the drawings, the preferred embodiment of the present invention generally concerns a thermally-insulative, breast-supportive undergarment 10 or brassiere as generally illustrated and referenced in FIGS. 1-3, and 4-5. Thermally-insulative, breast-supportive undergarment 10 preferably comprises an anterior fabric portion 11 as illustrated and referenced in FIGS. 1-15; a posterior fabric portion 12 as illustrated and referenced in FIGS. 2, 3, 6, and 11-14; and an elastic band member 13 as illustrated and referenced in FIGS. 1, 7, and 9-11. Anterior fabric portion 11 and posterior fabric portion 12 each preferably comprise or are constructed from thermally-insulative fabric materials. In this regard, excellent results have been obtained when anterior fabric portion 11 and posterior fabric portion 12 comprise or are constructed from POLARTEC® brand fleece type fabric material. POLARTEC® brand fleece is the preferred type of material used in the construction or assembly of anterior fabric portion 11 and posterior fabric portion 12 due to its bidirectional (or east-west) fabric elasticity. The east-west or bidirectional fabric elasticity is oriented in the garment so that the assembled garment comprises girthwise elasticity. In other words, the elasticity functions to allow fabric stretch in directions defined by the intersection of a series of transverse planes and the areas in immediate superficial adjacency to the skin of the thoracic and abdominal regions. Thus, it will be understood that the fabric elasticity is primarily latitudinally-oriented as generally referenced at 14 in FIG. 6. Preferably, the bidirectional fabric elasticity has a modest (or modestly strong) fabric spring constant for providing some modest degree of fabric resilience to stretching so as to provide for both a snug fit as well as to provide some level of breast-supportive fabric resilience.

Anterior fabric portion 11 preferably comprises an anterior portion periphery, the anterior portion periphery having a relaxed anterior periphery dimension. In other words, when anterior fabric portion 11 is in a relaxed or unstretched state (i.e. when not worn), the anterior portion periphery has a certain pre-selected magnitude. Preferably, the thermally-insulative fabric extends intermediate the closed anterior portion periphery, and thus, it will be understood that the thermally-insulative fabric is designed to thermally insulate a certain surface area of skin when the assembled garment is donned. The anterior portion periphery preferably comprises an anterior neck portion 15 as illustrated in FIGS. 1, 3, 4, 7-11, 13, and 15; an anterior midriff portion 16 as illustrated and referenced in FIGS. 1, 3, 4-11, 13 and 15; laterally opposed anterior arm portions 17 as illustrated and referenced in FIGS. 1-3, and 4-15; and a plurality of anterior seam sections 18 as illustrated and referenced in FIGS. 1, 3, 4-11, 13, and 15.

Figure 11:
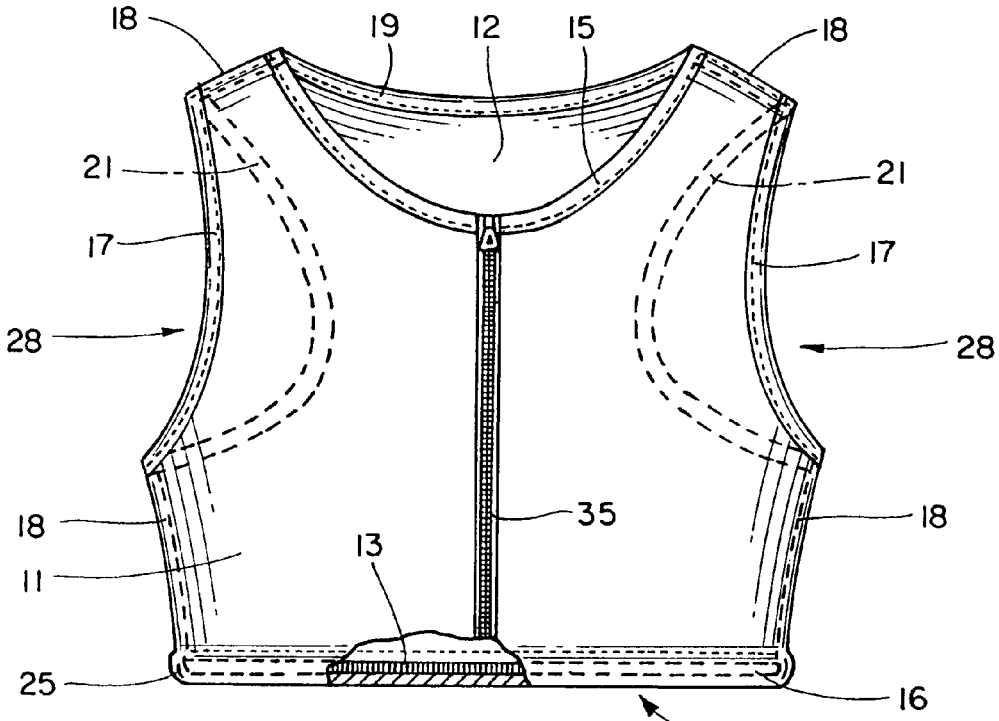
FIG. 11 is a front plan view of a sixth alternative embodiment of the thermally-insulative, breast-supportive undergarment showing slide fastener structure.

Similar to anterior fabric portion 11, posterior fabric portion 12 has a posterior portion periphery, the posterior portion periphery also having a relaxed posterior periphery dimension. The posterior portion periphery preferably comprises a posterior neck portion 19 as illustrated and referenced in FIGS. 2, and 11-14; a posterior midriff portion 20 as illustrated and referenced in FIGS. 2, 3, 6, 12, and 14; laterally opposed posterior arm portions 21 as illustrated and referenced in FIGS. 1, 2, 6, and 11-14; and a plurality of posterior seam sections 22 as illustrated and referenced in FIGS. 2, 4-6, 12, 14, and 15. Notably, the relaxed anterior periphery dimension is preferably greater in magnitude than the relaxed posterior periphery dimension so that when anterior seam sections 18 are preferably stitched, sewn or otherwise fixedly attached to posterior seam sections 22, anterior fabric portion 11 covers a potentially greater skin surface area than posterior fabric portion 12 as may be generally understood form comparative inspection of FIG. 1 versus FIG. 2; FIG. 11 versus FIG. 12; and FIG. 13 versus FIG. 14. From a general inspection of the noted figures, it will thus be seen that the relaxed anterior periphery dimension of anterior fabric portion 11 is relatively greater than the relaxed posterior periphery dimension of posterior fabric portion 12.

Figure 4:
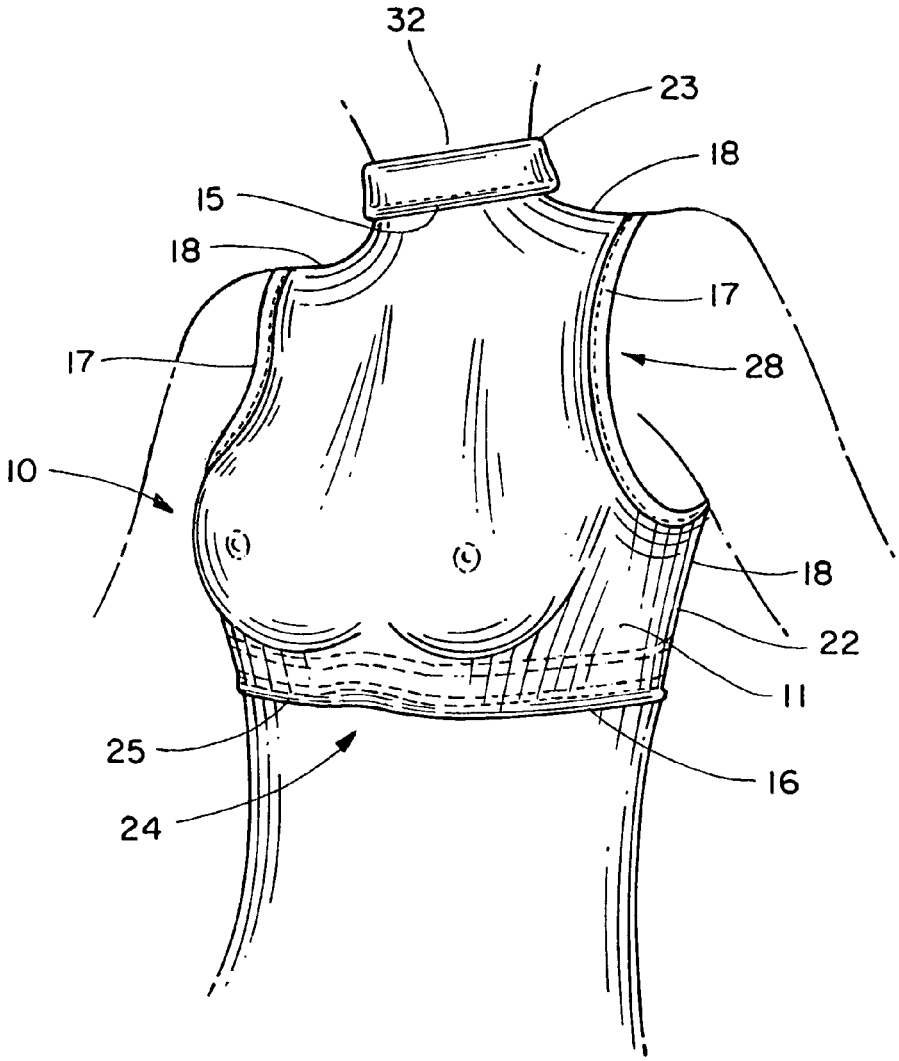
FIG. 4 is a perspective view of the preferred embodiment of the thermally-insulative, breast-supportive undergarment as donned by a wearer showing a folded-over neck-covering sleeve.
Figure 5:
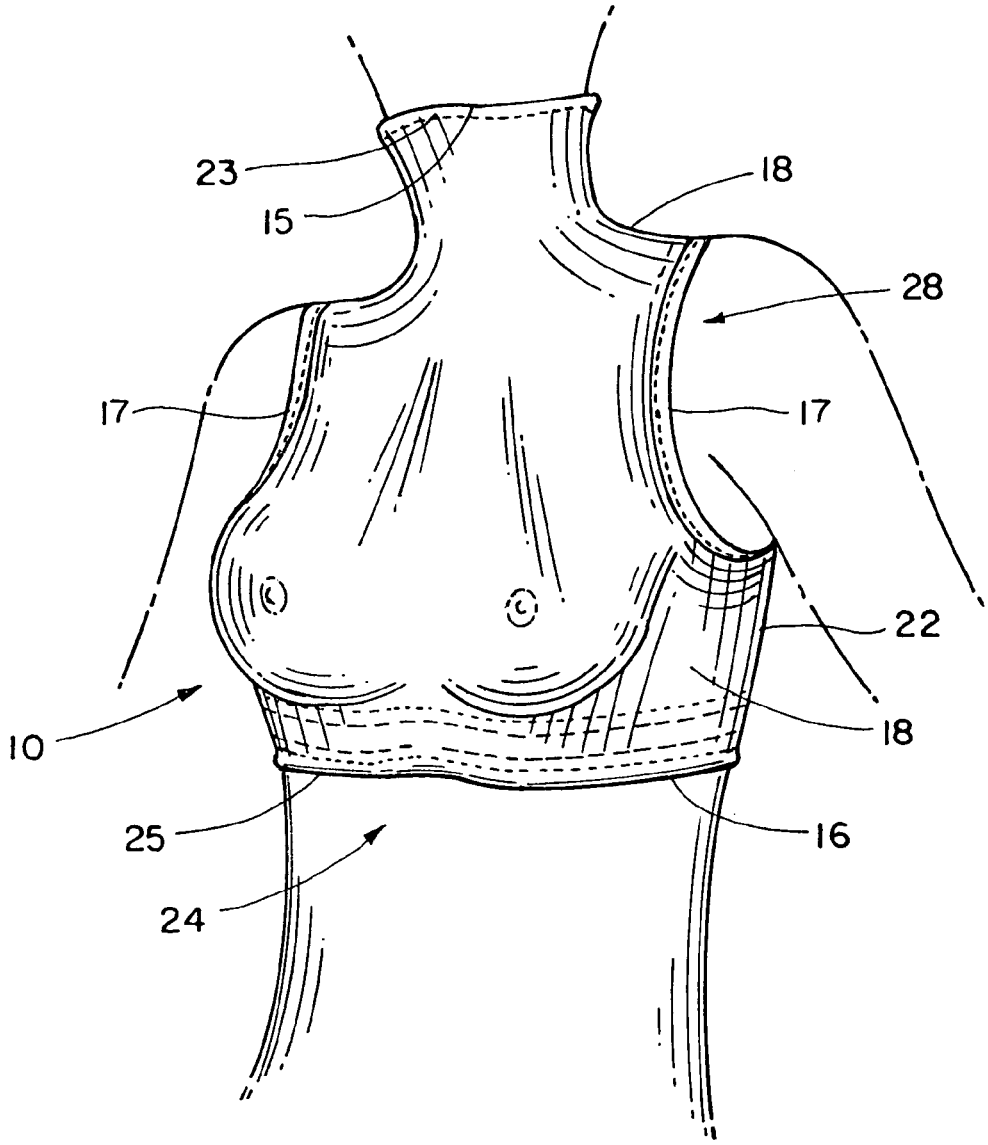
FIG. 5 is a perspective view of the preferred embodiment of the thermally-insulative, breast-supportive undergarment as donned by a wearer showing a fully extended neck-covering sleeve.
Figure 6:
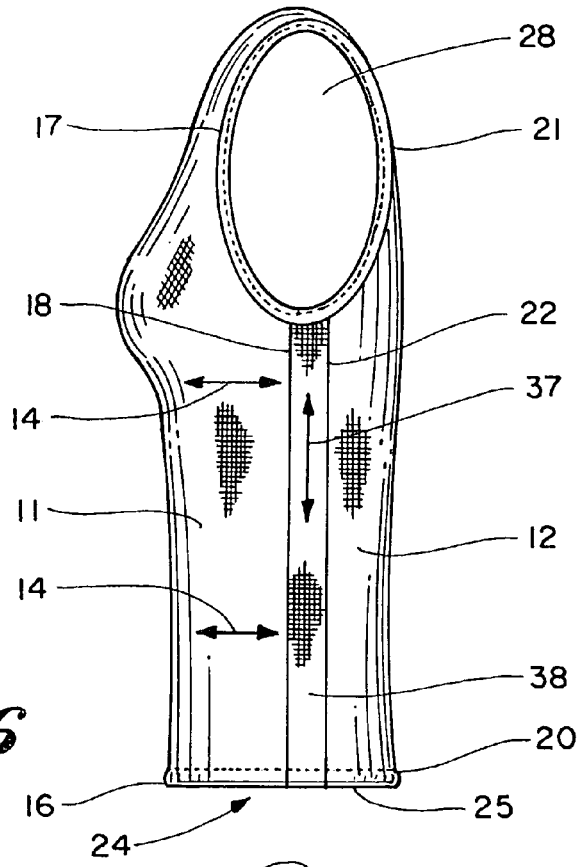
FIG. 6 is a side plan view of a first alternative embodiment of the thermally-insulative, breast-supportive undergarment having comprising material sections diagrammatically having latitudinally-oriented bidirectional elasticity and longitudinally-oriented bidirectional elasticity.

It will be understood from an inspection of the applicable drawing figures that anterior neck portion 15 and posterior neck portion 19 cooperatively form a neck-covering leeve 23 as generally illustrated and referenced in FIGS. 1-3, 4, 5, and 7-10. Notably, neck-covering sleeve 23, preferably being constructed from thermally-insulative fleece material, is foldable. Thus, neck-covering sleeve 23 is foldable upon itself as may be seen from a general inspection of FIGS. 3 and 4. Neck-covering sleeve 23, when folded upon itself, inherently has a fold line. It is contemplated that the foldable neck-covering sleeve 23 or turtleneck type structure is designed to selectively expose certain of a wearer's supraclavicular anatomy, the supraclavicular anatomy being defined as those areas of the wearer's anatomy in superior adjacency to clavicular areas. Thus, it will be understood that in the present application, the supraclavicular anatomy generally refers to those areas of anatomy in superior adjacency to the fold line (the fold line typically being spatially located superior to the clavicular region(s))) as may be seen from a general inspection of FIG. 4 and as referenced at 32. It is further contemplated that neck-covering sleeve 23 may be of sufficient length so that when fully extended, the superior most portion of sleeve may cover the wearer's chin and/or nose so as to potentially provide an insulative garment for thermally-insulating the lower portions or regions of a wearer's face as generally illustrated in FIG. 5.

The anterior and posterior midriff portions 16 and 20 thus further cooperatively form a midriff-receiving aperture 24 as illustrated and referenced in FIGS. 1-3, and 4-15. Midriff-receiving aperture 24 may comprise select midriff-encircling structure, the select midriff-encircling structure being selected from the group consisting of a preferred midriff-exposing terminus 25 as illustrated and referenced in FIGS. 3, 4-6, and 9-15; and a select midriff-covering sleeve. The select midriff-covering sleeve may alternatively be selected from the group consisting of a waistline tuckable sleeve 26 as illustrated and referenced in FIG. 8; and a waistline-terminating sleeve 27 as illustrated and referenced in FIG. 7. Waistline tuckable sleeve 26 is preferably designed to be of sufficient length to be tuckable under garmentry located at the waistline, such as trousers, skirts and the like which typically have a superior terminus spatially located at the waistline and which may receive tucked garmentry or clothing. Notably, clothing that is tuckable need not comprise superfluous elasticity and thus it will be noted from a general inspection of FIG. 8 that waistline tuckable sleeve 26 need not comprise an elastic band member 13. Conversely, waistline-terminating sleeve 27 is designed to preferably extend to an area in superior adjacency to garmentry located at the waistline, as earlier specified. In other words, waistline-terminating sleeve 27 extends to and abuts garmentry located at the waistline and is not tucked thereunder. It should be noted that regardless of the midriff-covering lengths of either waistline tuckable sleeve 26 or waistline-terminating sleeve 27, elastic band member 13 is preferably located in inferior adjacency to the breast region of a wearer's torso (as generally illustrated in FIGS. 4 and 5) so as to provide breast-supportive fabric resilience as earlier specified.

The anterior and posterior arm portions 17 and 21, when anterior fabric portion 11 and posterior fabric portion 12 are preferably stitched or sewn together at the previously specified seam sections 18 and 22, thus cooperatively form laterally opposed arm-receiving apertures or arm-exposing structure(s) 28 as generally illustrated and referenced in FIGS. 1-3, 4-6, and 9-15. In other words, sleeveless upper body garments or upper body garments without sleeves have certain arm-receiving apertures, which define certain arm-exposing structure. This structure is referenced at 28 in the noted figures. Arm-receiving apertures or structure(s) 28 each comprise select arm-receiving structure, the select arm-receiving structure being selected from the group consisting of a preferred tank top style arm opening as generally referenced at 29 in FIGS. 1-3, 4-6, and 9-15; and alternatively, select arm-covering sleeve structure.

Figure 7:
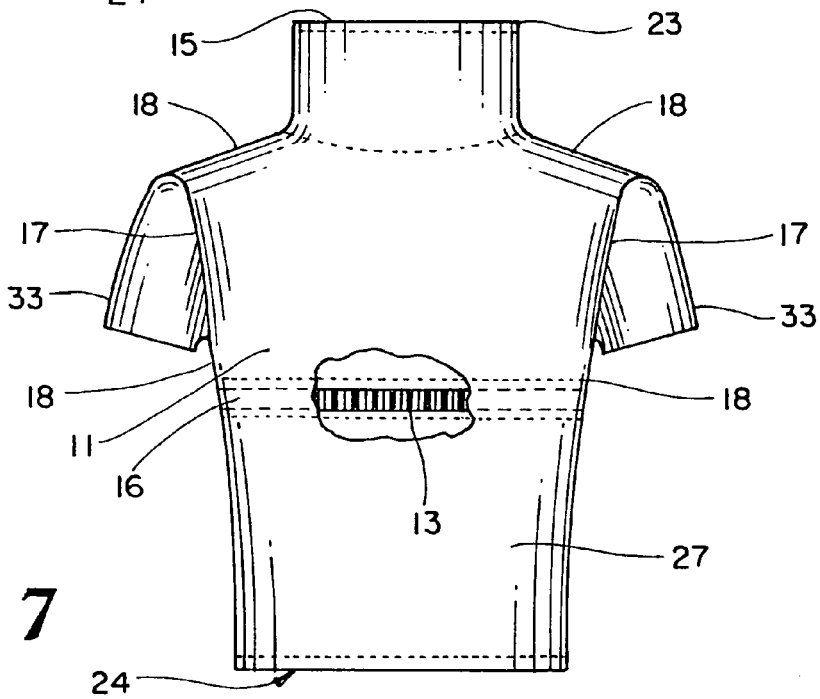
FIG. 7 is front plan view of a second alternative embodiment of the thermally-insulative, breast-supportive undergarment showing an extended neck-covering sleeve, relatively short arm-covering sleeves, a midriff-covering portion, and parts broken away to show an elastic band member.

More particularly, the select arm-covering sleeve structure may be defined by various arm-covering sleeves, which sleeves essentially comprise varying sleeve lengths. Thus, it will be understood that the select arm-covering sleeve structure may preferably be defined by a select sleeve length, which select sleeve length is selected from a sleeve length range, the sleeve length range ranging from a "greater-than-zero" sleeve length (or some minimal amount of sleeve structure attached to the respective arm-receiving aperture) to a full-sleeve length (or some sleeve length that typically does not extend beyond the hands of the wearer). In this regard, for example, it will be seen from a comparative inspection of FIGS. 7 and 8 that varying sleeve lengths may be attached to arm-receiving apertures or structure(s) 28. In FIG. 7, relatively shorter sleeve lengths are attached to arm-receiving apertures or structure(s) 28 (as referenced at 33) and in FIG. 8, relatively longer sleeve lengths are attached to arm-receiving apertures 28 (as referenced at 34).

The elastic band member 13 is preferably cooperatively associated with the midriff-receiving aperture 24. In this regard, it will be understood that elastic band member 13 is preferably stitched to areas of anterior fabric portion 11 and posterior fabric portion 12 such that elastic band member 13 is essentially enveloped by anterior fabric portion 11 and posterior fabric portion 12 (anterior fabric portion 11 and posterior fabric portion 12 being folded upon themselves in enveloped relation around elastic band member 13). It is contemplated that elastic structure is commonly attached to fabric in such a manner and those skilled in the art need no further descriptions of how to otherwise properly attach or cooperatively associate elastic structure with fabric.

Preferably, elastic band member 13 is formed or constructed from so-called "no-roll" type elastic and thus it will be further understood that elastic band member 13 does preferably comprise bidirectional band elasticity. The bidirectional band elasticity is preferably latitudinally-oriented and has a band spring constant, the band spring constant being greater in magnitude than the fabric spring constant so as to provide a relatively stronger degree of fabric resilience at midriff portions 16 and 20. Thus, it will be understood that the fabric elasticity and the band elasticity cooperate to provide breast-supportive fabric resilience. Further, it will be understood that the thermally-insulative material, the fabric elasticity, and the band elasticity together provide a user or wearer with a thermally-insulative, breast-supportive undergarment.

Should the consumer or user of the present invention be desirous of obtaining a dual-functioning thermally-insulative undergarment or outer wear type garment such as a camisole, it is contemplated that elastic band member 13 may be eliminated from the design and thus the resulting structure provides thermally-insulative camisole type structure or a more modest breast-supportive structure. It is noted that consumers or users having less need for breast support often opt to purchase or utilize camisole type garments as opposed to the more confining brassiere type structure. It is with this notion in mind that the camisole is here mentioned and offered to users of the present invention as a viable alternative.

Given the thermally-insulative anatomical-covering properties of the present invention, it is contemplated that perspiration may become problematic in some applications. In this regard, it is noted that fleece is a superior moisture-wicking material and thus does function to wick moisture or perspiration away from skin surfaces. However, it is further contemplated that the present invention may comprise moisture-wicking lining structure in addition to the fleece material. Thus, the thermally-insulative, breast-supportive undergarment may further preferably comprise an anterior liner portion 30 as illustrated and referenced in FIGS. 3 and 3(*a*); and a posterior liner portion (not specifically shown or illustrated). Anterior liner portion 30 and the posterior liner portion are each preferably constructed from or comprise moisture-wicking material for wicking moisture, such as perspiration, away from the skin as a means to enhance the thermally-insulative properties as well as the overall comfort of the undergarment. Notably, however, the moisture-wicking material preferably comprises bidirectional liner elasticity, the bidirectional liner elasticity being latitudinally-oriented as earlier described. The bidirectional liner elasticity inherently comprises or has a liner spring constant preferably substantially equal in magnitude to the fabric spring constant.

Anterior liner portion 30 inherently comprises or has an anterior liner periphery, which has a relaxed anterior liner dimension. The anterior liner dimension may, in the preferred embodiment be substantially equal in magnitude to the relaxed anterior periphery dimension. It is contemplated, however, that some users may wish to have an undergarment with only certain areas being lined. With this notion in mind, it is contemplated that the relaxed anterior liner dimension may, in some instances or embodiments, be lesser in magnitude than the relaxed anterior periphery dimension. Similarly, the posterior liner portion has a posterior liner periphery, the posterior liner periphery having a preferred relaxed posterior liner dimension substantially equal in magnitude to the relaxed posterior periphery dimension. Notably, both anterior liner portion 30 and the posterior liner portion are preferably formed with the undergarment so as to be deeply and cooperatively associated with anterior fabric portion 11 and posterior liner portion 12, respectively as may be more clearly understood from a general inspection of FIGS. 3 and 3(*a*). As is common in the art, liners or lining structure is typically situated deep to superficially located garmentry or outerwear. Thus, it will be understood that anterior liner portion 30 and the posterior liner portion are deeply and cooperatively associated with anterior fabric portion 11 and posterior fabric portion 12, respectively.

Alternative Embodiments

Figure 8:
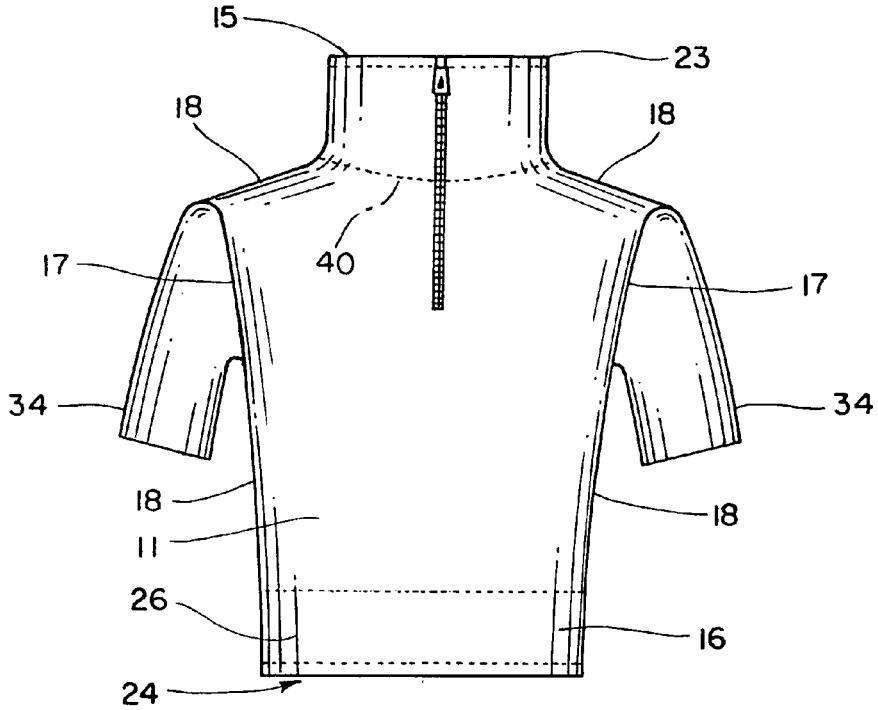
FIG. 8 is front plan view of a third alternative embodiment of the thermally-insulative, breast-supportive undergarment showing an extended neck-covering sleeve, relatively long arm-covering sleeves, and a midriff-covering portion.
Figure 9:
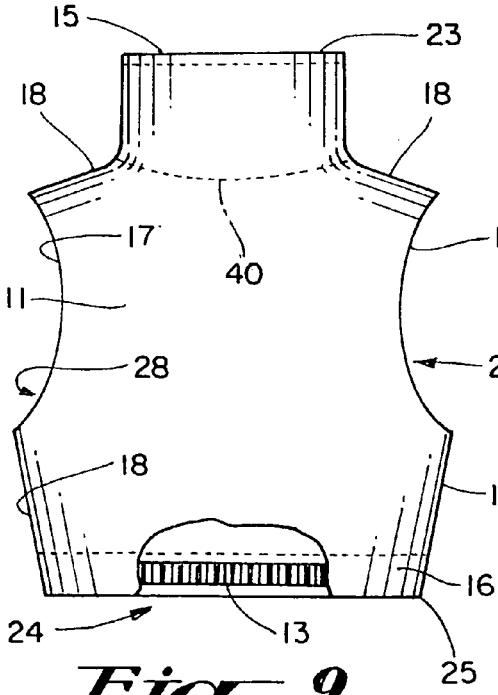
FIG. 9 is a front plan view of a fourth alternative embodiment of the thermally-insulative, breast-supportive undergarment showing a separately stitched and extended neck-covering sleeve, and parts broken away to show an elastic band member.
Figure 10:
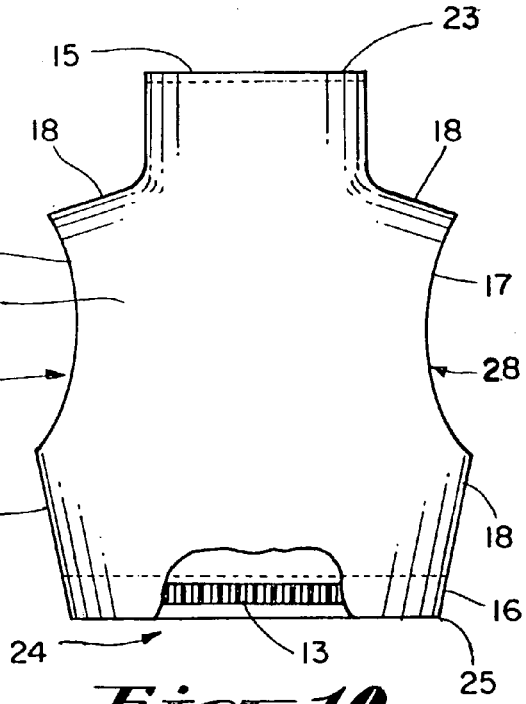
FIG. 10 is a front plan view of a fifth alternative embodiment of the thermally-insulative, breast-supportive undergarment showing an integrally formed, extended neck-covering sleeve, and parts broken away to show an elastic band member.
Figure 12:
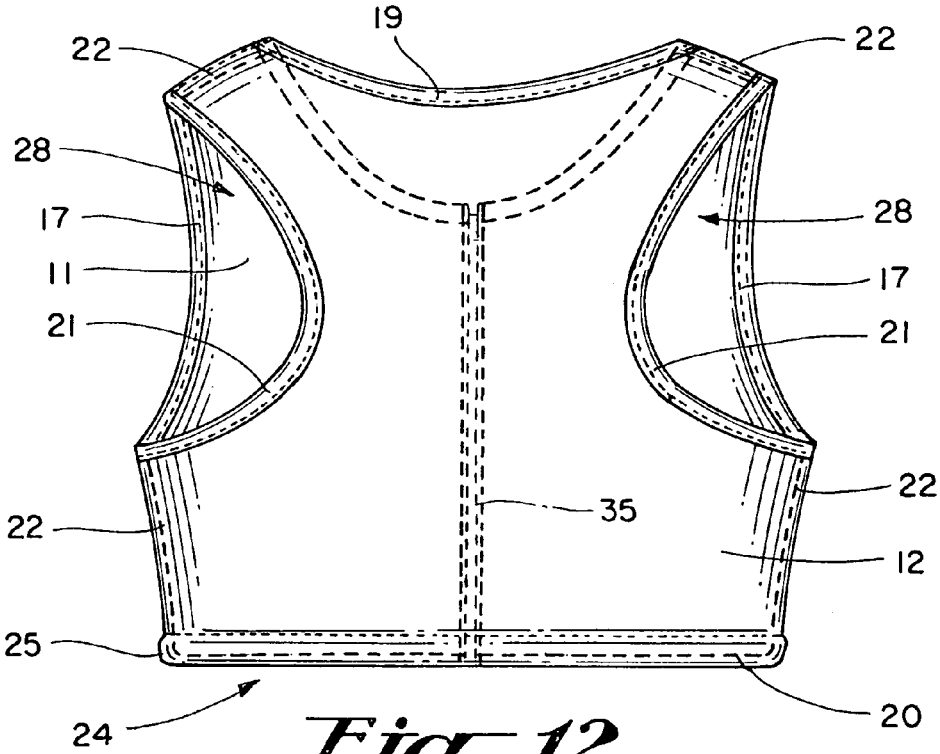
FIG. 12 is a back plan view of the sixth alternative embodiment illustrated in FIG. 11.
Figure 13:
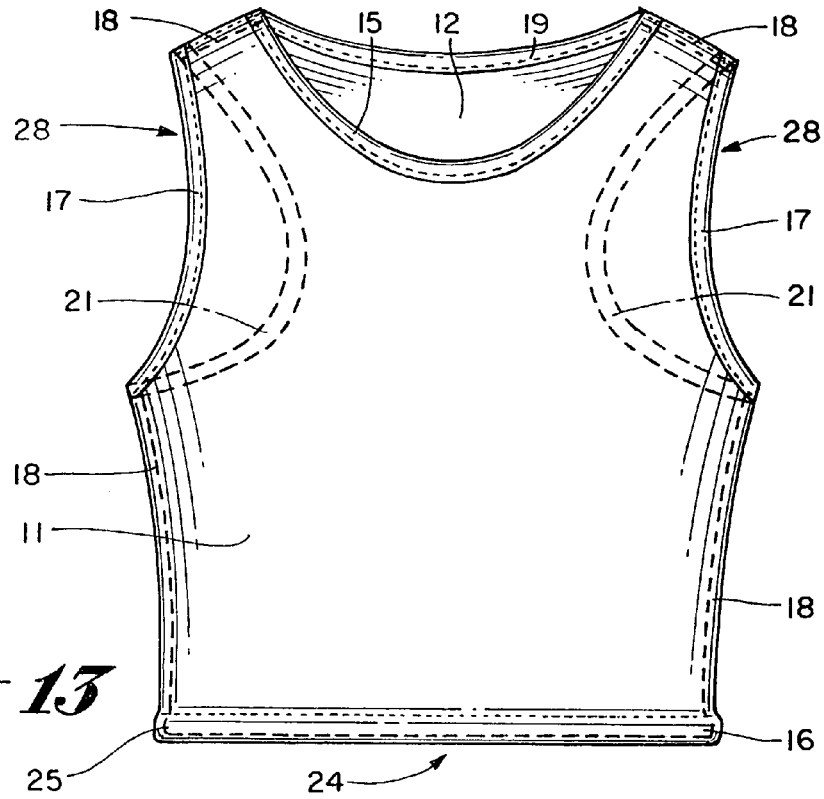
FIG. 13 is a front plan view of a seventh alternative embodiment of the thermally-insulative, breast-supportive undergarment showing an alternative neck-receiving aperture.
Figure 14:
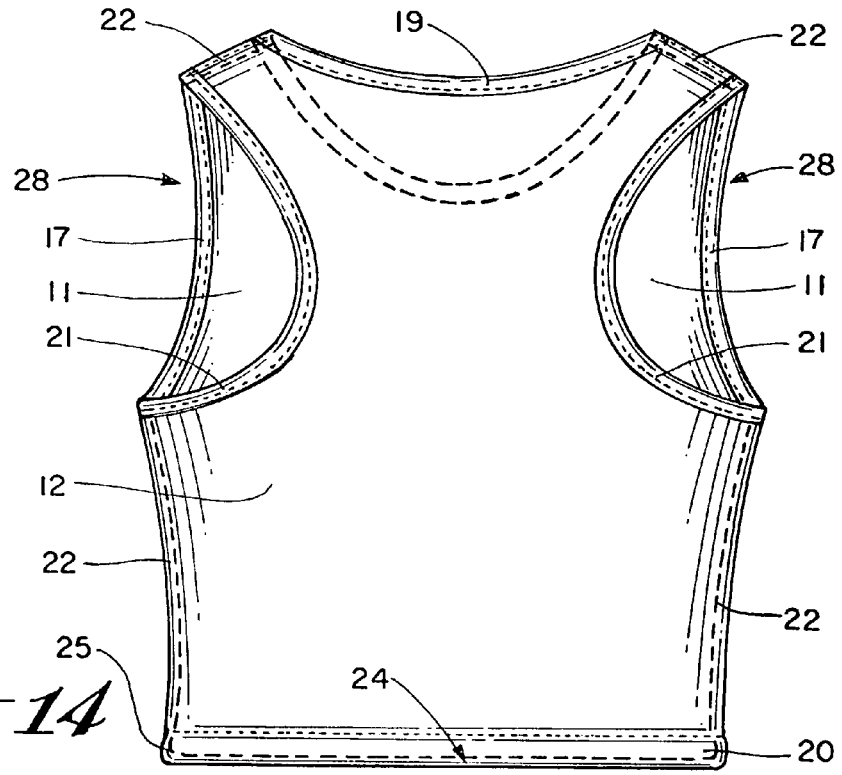
FIG. 14 is a back plan view of the seventh alternative embodiment illustrated in FIG. 13.
Figure 15:
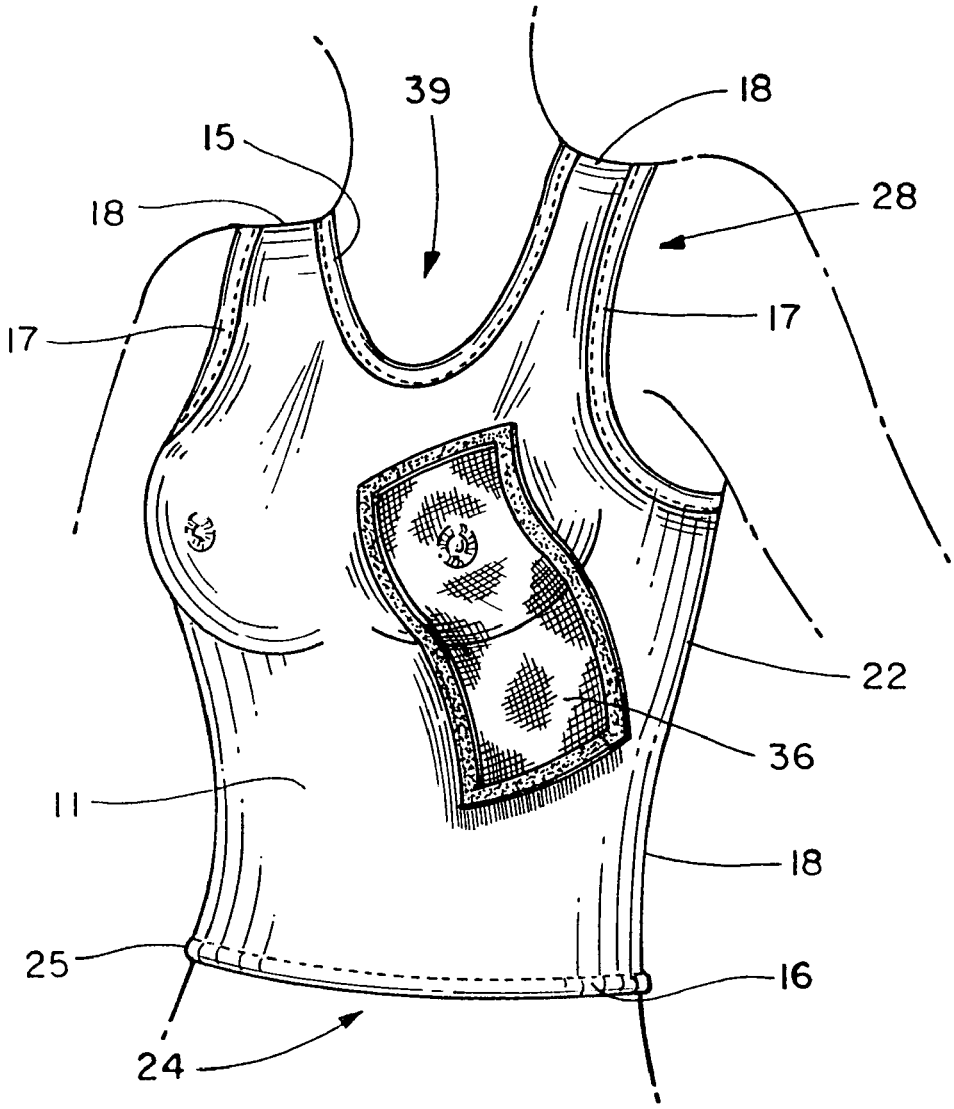
FIG. 15 is a perspective view of an eighth alternative embodiment of the thermally-insulative, breast-supportive undergarment showing breast-exposing structure.

Additional alternatives to the preferred embodiment of the thermally-insulative, breast-supportive undergarment include an anterior fabric portion 11, wherein the anterior fabric portion comprises select anatomy-exposing means. It is contemplated that the select anatomy-exposing means may be designed to selectively expose infraclavicular portions of the wearer's anatomy. In this regard, for example, it is contemplated that anterior fabric portion 11 may comprise slide fastener means or zipper means as generally referenced at 35 in FIGS. 11 and 12. The slide fastener means or zipper means 35, as shown in FIGS. 11 and 12, generally function to expose anatomy extending laterally from the sternal region. However, the slide fastener means or zipper means 35 may be situated in various regions of anterior fabric portion 11 for exposing other infraclavicular anatomical areas. Further, as is generally illustrated in FIG. 15, the select anatomy-exposing means may be designed to expose certain portions of a user's breast or breasts. It is contemplated, for example, that nursing mothers may benefit from a maternity or nursing type version of the disclosed invention and thus it is contemplated that the select anatomy-exposing means may be defined by certain breast-exposing structure (as referenced at 36) for enabling a mother to expose a breast or nipple for nursing purposes and the like. Further, it is contemplated that the select anatomy-exposing means may be defined by certain anterior neck/sternum-exposing structure as generally illustrated in FIG. 8 at 41. It will be seen from an inspection of FIG. 8 that the anatomy-exposing means as referenced at 41 comprises means for opening the anterior portion of neck-covering sleeve 23 as well as the medial and superior portions of anterior fabric portion 11. Further, it is contemplated that other select anatomy-exposing means, in addition to zipper means or slide fastening means, may include buttons, hook and loop type fastening means, and other garment-related type fastening structure otherwise commonly known in the art.

It is further contemplated that the thermally-insulative, breast-supportive undergarment of the present invention may be designed with differing torso sizes in mind so that a single article may operate to fit differently sized users. In this regard, it is contemplated that the thermally-insulative, breast-supportive undergarment may alternatively comprise torso size-adjusting means. It is contemplated that the torso size-adjusting means may be integrally formed with at least one select fabric portion, the select fabric portion being selected from the group consisting of anterior fabric portion 11 and posterior fabric portion 12. It is contemplated that the torso size-adjusting means may be defined by at least one thermally-insulative material section 38 as may be seen illustrated and referenced in FIG. 6. Notably, the thermally-insulative material section 38 has bidirectional fabric elasticity, which is preferably non-latitudinally oriented or longitudinally oriented as generally depicted at 37 in FIG. 6.

This feature allows the manufacturer to place non-latitudinally oriented bidirectional fabric stretch in key areas of the undergarment according to the needs of the user by simply stitching or sewing in pieces of the fabric at the desired location and in the desired orientation so as to make more proper use of the fabric elasticity. It is further contemplated, although not specifically illustrated, that additional fabric stretch such as here described is most often beneficial if placed at the shoulder regions extending from anterior shoulder portions to posterior shoulder portions. It is further contemplated that the torso-size adjusting means may be defined by elastic type material, either in isolation or in combination with other fabric having bidirectional elasticity, and may preferably be found at the shoulder regions as heretofore specified.

It is further contemplated that while the preferred embodiment of the present invention describes a thermally-insulative, breast-supportive undergarment having neck-covering sleeve 23 or similar other turtleneck type structure, the undergarment may alternatively comprise select neck-encircling structure selected from the group consisting of a neck-covering sleeve and select neck-exposing aperture. The select neck-exposing aperture may be selected from the group comprising a V-neck style neck opening (not specifically referenced), a crew neck style opening (not specifically referenced), and a tank top style neck opening 39 as generally referenced in FIGS. 11-15. In this regard, it should be further noted that if neck-covering sleeve 23 is to be included in the design of the undergarment, the sleeve portions (front and back) may be integrally formed with anterior fabric portion 11 and posterior fabric portion 12 as generally depicted in FIGS. 1-3, 4, 5, and 10; or the sleeve portions (front and back) may be separately stitched or sewn to neck portions 15 and 19. The stitch line associated with separately stitched front and back sleeve portions is generally referenced at 40 in FIGS. 7-9. It is noted that if the front and back sleeve portions of the neck-covering sleeve 23 were to be removed from the undergarment, a crew neck type neck-exposing aperture would result.

While the above description contains much specificity, this specificity should not be construed as limitations on the scope of the invention, but rather as an exemplification of the invention. For example, it is believed that the spirit of the present invention discloses a thermally-insulative, breast-supportive undergarment comprising an anterior fabric portion and a posterior fabric portion, each of which comprises thermally-insulative fabric material having fabric elasticity, the fabric elasticity having a fabric spring constant inherently associated therewith. The anterior fabric portion comprises an anterior neck portion, an anterior midriff portion, laterally opposed anterior arm portions, and a plurality of anterior seam sections. The posterior fabric portion comprises a posterior neck portion, a posterior midriff portion, laterally opposed posterior arm portions, and a plurality of posterior seam sections. The anterior seam sections are stitched or otherwise attached to the posterior seam sections. Thus, the anterior and posterior neck portions thus cooperatively form select neck-encircling structure, the anterior and posterior midriff portions thus cooperatively form a midriff-receiving aperture, and the anterior and posterior arm portions thus cooperatively form laterally opposed arm-receiving apertures. The fabric elasticity provides breast-supportive resilience. Together, the thermally-insulative material and the fabric elasticity thus provide a wearer with a thermally-insulative, breast-supportive undergarment.

The undergarment may comprise an elastic band member, which is cooperatively associated with the midriff-receiving aperture as earlier described. The elastic band member has band elasticity having a band spring constant, the band spring constant being greater in magnitude than the fabric spring constant. The band elasticity thus provides the undergarment with additional breast-supportive fabric resilience. Preferably, both the fabric elasticity and the band elasticity is bidirectional, the bidirectional elasticity being latitudinally oriented. Further, it is contemplated that any of a wide variety of neck openings, arm openings and midriff apertures may be styled according to the specifications here outlined and still be within the scope of the described and claimed invention. Further, as earlier indicated, it is contemplated that the present invention may be utilized as an outerwear type garment, particularly given the specification that the preferred materials comprise fleece type materials (which are commonly worn as outerwear).

Accordingly, although the invention has been described by reference to a preferred embodiment, and two alterative embodiments, it is not intended that the novel assembly or apparatus be limited thereby, but that modifications thereof are intended to be included as falling within the broad scope and spirit of the foregoing disclosure, the following claims and the appended drawings.

I claim:

1. A breast-supportive undergarment, the breast-supportive undergarment comprising an anterior fabric portion, a posterior fabric portion, and an elastic band member, the anterior fabric portion and the posterior fabric portion each having bidirectional fabric elasticity, the bidirectional fabric elasticity being latitudinally-oriented, the anterior fabric portion having a anterior portion periphery, the anterior portion periphery having a relaxed anterior periphery dimension, the posterior fabric portion having a posterior portion periphery, the posterior portion periphery having a relaxed posterior periphery dimension, the relaxed anterior periphery dimension being greater in magnitude than the relaxed posterior periphery dimension, the anterior portion periphery being stitched to the posterior portion perirphery thereby cooperatively forming a neck-encircling portion, a midriff-receiving aperture, and laterally opposed arm-receiving apertures, the neck-encircling portion being foldable upon itself, the neck-encircling portion, when folded upon itself, exposing a wearer's neck the elastic band member being cooperatively associated with the midriff-receiving aperture, the elastic band member having bidirectional band elasticity, the bidirectional band elasticity being latitudinally-oriented, the fabric elasticity and the band elasticity for providing a user with a breast-supportive undergarment.

2. The breast-supportive undergarment of claim 1 wherein the undergarment comprises an anterior liner portion and a posterior liner portion, the anterior liner portion and the posterior liner portion each comprising moisture-wicking material, the moisture-wicking material having bidirectional liner elasticity, the bidirectional liner elasticity being latitudinally-oriented, the anterior liner portion having an anterior liner periphery, the anterior liner periphery having a relaxed anterior liner dimension coextensive with the relaxed anterior periphery dimension, the posterior liner portion having a posterior liner periphery, the posterior liner periphery having a relaxed posterior liner dimension coextensive with the relaxed posterior periphery dimension, the anterior liner portion being attached the anterior fabric portion and the posterior liner portion being attached the posterior fabric portion.

3. The breast-supportive undergarment of claim 2 wherein the relaxed anterior liner dimension is substantially equal in magnitude to the relaxed anterior periphery dimension, the relaxed posterior liner dimension is substantially equal in magnitude to the relaxed posterior periphery dimension, and the liner elasticity is substantially equal to the fabric elasticity.

4. The breast-supportive undergarment of claim 3 wherein the arm-receiving apertures are outfitted with arm-encircling structure.

5. The breast-supportive undergarment of claim 4 wherein the arm-encircling structure is defined by a select sleeve length, the select sleeve length being selected from a sleeve length range, the sleeve length range ranging from a greater-than-zero sleeve length to a fall-sleeve length.

6. The breast-supportive undergarment of claim 5 wherein the midriff-receiving aperture comprises select midriff-encircling structure, the select midriff-encircling structure being selected from the group consisting of a midriff-exposing terminus and a midriff-covering terminus.

7. The breast-supportive undergarment of claim 1 wherein the anterior fabric portion comprises fastening means for selectively exposing portions of the wearer's torso.

8. The breast-supportive undergarment of claim 7 comprising at least one material section integrally formed with either the anterior fabric portion or the posterior fabric portion, the material section having bidirectional fabric elasticity, the bidirectional fabric elasticity being non-latitudinally oriented.

9. The breast-supportive undergarment of claim, 1 wherein the anterior fabric portion and the posterior fabric portion comprise fleece material.

10. A breast-supportive undergarment, the breast-supportive undergarment comprising an anterior fabric portion and a posterior fabric portion, the anterior fabric portion and the posterior fabric portion each having bidirectional fabric elasticity, the bidirectional fabric elasticity being latitudinally-oriented, the anterior fabric portion having an anterior portion periphery, the anterior portion periphery having a relaxed anterior periphery dimension, the posterior fabric portion having a posterior portion periphery, the posterior portion periphery having a relaxed posterior periphery dimension, the relaxed anterior periphery dimension being greater in magnitude than the relaxed posterior periphery dimension, the anterior portion periphery being attached to the posterior portion periphery thereby cooperatively forming select neck-encircling structure, a midriff-receiving aperture, and laterally opposed arm-receiving apertures, the fabric elasticity providing breast-supportive resilience, the fabric elasticity thus for providing a user with a breast-supportive undergarment.

11. The breast-supportive undergarment of claim 10 wherein the undergarment comprises an anterior liner portion and a posterior liner portion, the anterior liner portion and the posterior liner portion each having bidirectional liner elasticity, the bidirectional liner elasticity being latitudinally-oriented, the anterior liner portion having an anterior liner periphery, the anterior liner periphery having a relaxed anterior liner dimension coextensive with the relaxed anterior periphery dimension, the posterior liner portion having a posterior liner periphery, the posterior liner periphery having a relaxed posterior liner dimension coextensive with the relaxed posterior periphery dimension, the anterior liner portion being attached the anterior fabric portion and the posterior liner portion being attached the posterior fabric portion.

12. The breast-supportive undergarment of claim 11 wherein the anterior liner portion and the posterior liner portion each comprise moisture-wicking material, the moisture-wicking material for wicking moisture away from the skin.

13. The breast-supportive undergarment of claim 12 wherein the relaxed anterior liner dimension is substantially equal in magnitude to a relaxed anterior periphery dimension, the relaxed posterior liner dimension is substantially equal in magnitude to the relaxed posterior periphery dimension, and the liner elasticity is substantially equal to the fabric elasticity.

14. The breast supportive undergarment of claim 10 comprising an elastic band member, the elastic band member being cooperatively associated with the midriff-receiving aperture, the elastic band member having bidirectional band elasticity, the bidirectional band elasticity being latitudinally-oriented, the band elasticity providing the undergarment with additional breast-supportive resilience.

15. The breast-supportive undergarment of claim 10 wherein the select neck-encircling structure is selected from the group consisting of a neck-covering portion and a select neck-exposing aperture, the select neck-exposing aperture being selected from the group comprising a V-neck style opening and a crew neck style opening.

16. The breast-supportive undergarment of claim 15 wherein the neck-covering portion is foldable upon itself, the neck-covering portion, when folded upon itself, for exposing a wearer's neck.

17. The breast-supportive undergarment of claim 10 wherein the arm-receiving apertures are outfitted with arm-encircling structure.

18. The breast-supportive undergarment of claim 17 wherein the arm-encircling structure is defined by a select sleeve length, the select sleeve length being selected from a sleeve length range, the sleeve length range ranging from a greater-tan-zero sleeve length to a fall-sleeve length.

19. The breast-supportive undergarment of claim 10 wherein the midriff-receiving aperture comprises select midriff-encircling structure, the select midriff-encircling structure being selected from the group consisting of a midriff-exposing terminus and a midriff-covering terminus.

20. The breast-supportive undergarment of claim 10 wherein the anterior fabric portion comprises fastening means for exposing select portions of the wearer's torso.

21. The breast-supportive undergarment of claim 20 comprising at least one material section integrally formed with either the anterior fabric portion or the posterior fabric portion, the material section having bidirectional fabric elasticity, the bidirectional fabric elasticity being non-latitudinally oriented.

22. The breast-supportive undergarment of claim 10 wherein the anterior fabric portion and the posterior fabric portion comprise fleece material.

23. A breast-supportive garment, the breast-supportive garment comprising an anterior fabric portion, a posterior fabric portion, an anterior liner portion and a posterior liner portion, the anterior fabric portion and the posterior fabric portion each having bidirectional, latitudinally-oriented fabric elasticity, the anterior liner portion and the posterior liner portion each having bidirectional, latitudinally-oriented liner elasticity, the anterior fabric portion being attached to the posterior fabric portion thereby cooperatively forming select neck-encircling structure, a midriff-receiving aperture, and laterally opposed arm-receiving apertures, the anterior liner portion being attached the anterior fabric portion and the posterior liner portion being attached the posterior fabric portion, the fabric and liner elasticity providing breast-supportive resilience, said elasticity thus for providing a wearer with a breast-supportive garment.

24. The breast-supportive garment of claim 23 wherein the anterior liner portion and the posterior liner portion each comprise moisture-wicking material, the moisture-wicking material far wicking moisture away from the skin.

25. The breast-supportive garment of claim 24 wherein the liner elasticity and the fabric elasticity are substantially equally resilient.

* * * * *

UNITED STATES PATENT AND TRADEMARK OFFICE

CERTIFICATE OF CORRECTION

PATENT NO. : 7,415,734 B2
APPLICATION NO. : 10/988817
DATED : August 26, 2008
INVENTOR(S) : Jennifer B. Donnelly It is certified that error appears in the above-identified patent and that said Letters Patent is hereby corrected as shown below:

Col. 7, Line 65
"leeve" should be "sleeve"

Col. 14, Line 62
"tan" should be "than"

Col. 16, Line 14
"far" should be "for"

Signed and Sealed this

Seventh Day of September, 2010

David J. Kappos

David J. Kappos
*Director of the United States Patent and Trademark Office*